United States Patent [19]

Tiramani et al.

[11] Patent Number: 5,042,658

[45] Date of Patent: Aug. 27, 1991

[54] HOLDER FOR A PERSONAL RAZOR

[75] Inventors: Paolo Tiramani, Greenwich, Conn.; Thomas Van Dyk, Prospect Park, N.J.

[73] Assignee: Goody Products, Inc., Kearney, N.J.

[21] Appl. No.: 558,083

[22] Filed: Jul. 24, 1990

[51] Int. Cl.[5] ..... A45C 11/26

[52] U.S. Cl. ..... 206/349; 206/352; 206/228; 206/37; 220/337; 30/90

[58] Field of Search ..... 206/38, 37, 15.2, 15.3, 206/208, 349, 362.2, 362.3, 461, 470, 471, 581, 352, 351, 228; 30/32, 41, 90; 220/339

[56] References Cited

U.S. PATENT DOCUMENTS

| | | | |
|---|---|---|---|
| 1,086,659 | 2/1914 | Ferenc | 206/362.2 |
| 1,651,496 | 12/1927 | Weinberg | 206/362.3 |
| 2,342,207 | 2/1944 | McVey | 30/90 |
| 2,538,337 | 1/1951 | Spears | 206/362.2 |
| 3,127,985 | 4/1964 | Scott | 206/362.3 |
| 3,339,608 | 9/1967 | Brenner | 206/352 |
| 3,382,523 | 5/1968 | Parsison | 206/362.3 |
| 3,735,860 | 5/1973 | Nissen et al. | 206/349 |
| 4,005,776 | 2/1977 | Seely | 206/470 |
| 4,162,004 | 7/1979 | Thomas | 206/349 |
| 4,371,079 | 2/1983 | Dembicks | 206/349 |
| 4,378,068 | 3/1983 | Bell | 206/470 |
| 4,702,374 | 10/1987 | Kelner | 206/471 |
| 4,865,188 | 9/1989 | Custeau | 206/15.2 |
| 4,921,096 | 5/1990 | McFarlane | 206/349 |
| 2,5811,188 | 6/1950 | Whipple | 30/90 |

OTHER PUBLICATIONS

Techform Inc., Thermoforming Advertisement, Nov. 15, 1982.

*Primary Examiner*—David T. Fidei

*Attorney, Agent, or Firm*—Abelman Frayne Rezac & Schwab

[57] ABSTRACT

A case for the storage of single edged razors is formed as a unitary molding comprising a first tubular portion for reception of a handle of the razor, and a second tubular portion offset on one side of a plane including the longitudinal axis of the first portion for the reception of the neck and blade of the razor, the second tubular member being comprised of two portions interconnected one with the other by a living hinge. The hinged portion being provided with a locking member for cooperation with the first tubular member.

4 Claims, 1 Drawing Sheet

HOLDER FOR A PERSONAL RAZOR

FIELD OF THE INVENTION

This invention relates to a case for a single-edged personal razor, which is adapted to contain and protect the majority of the commonly known forms of personal cartridge blade razors presently available to the public. Those razors have an elongated handle and a razor blade retaining structure at one end of the handle which extends transversely of the longitudinal axis of the handle, and which is offset with respect to the handle axis.

BACKGROUND OF THE INVENTION

Personal razors that are intended for extended usage and which have replaceable razor blades, commonly are sold to the public in a permanent or semi-permanent case adapted to positionally hold the razor and protect the razor blade. Equally commonly, so called disposable razors are supplied to the public with a disposable covering on the blade containing portion of the razor, which is disposed of by the user at the time of use.

The present invention has application more particularly to the first type of razor having replaceable blades. Typically, such razors are supplied in bulky cases, usually comprised of stamped metal casing portions with a molded inner lining for holding and retaining the razor, or more commonly, are formed of two or more moldings of thermoplastics material that are a snap fit one to the other.

In the former instance, the cases are heavy, bulky and unwieldly. In the latter instance the cases are of lighter weight but of equal bulk, and, are prone to breakage if roughly handled.

SUMMARY OF THE INVENTION

The object of this invention is to provide a case for a personal razor that is extremely simple in construction, is highly resistant to damage by impact, and which can accommodate the majority of the commonly known forms of cartridge blade personal razors presently available to the public.

According to the present invention, the case for a personal razor is comprised of a first tubular member having a closed end and an open end, and a second tubular member which is formed integrally with the first tubular member and which extends transversely of the longitudinal axis of the first tubular member at the open end of the first tubular member, the second tubular member extending entirely to one side of a plane including the longitudinal axis of the first tubular member.

The second tubular member is comprised of a first portion which is integral with the first tubular member and which has a substantially planar open side extending transversely of the first tubular member. The first portion terminates at its edge remote from the first tubular member in a living hinge formed integrally with the first portion and which connects the first portion to a second portion which also has a substantially planar open side.

The first and second portions are thus hingeable relative to each other to bring the second portion into overlying seated relation with the first portion, thus to provide a manually operable closure for said second tubular member.

The positioning of the living hinge at a position spaced from the longitudinal axis of the first tubular member provides protection for a naked blade of a cartridge blade razor during its insertion into the case and during closure of the second portion onto the first portion, the inner walls of the first tubular member and those of the first portion and second portion of the second tubular member each then providing protective surfaces within the case, the razor being free to move in random directions within the case, there being no necessity to provide members for securing the razor against such random movement.

The second portion of the first tubular member has formed integrally therewith a locking member for cooperation with the first tubular member upon hinging of the second portion about the living hinge.

Further, the entire assembly can be formed as a unitary molding from polypropylene material in a one-shot molding operation.

The molded assembly can be devoid of sharp edges, thus facilitating its ready inclusion in personal luggage without fear of damage to adjacent articles.

DESCRIPTION OF THE DRAWINGS

The invention will now be described with reference to the accompanying drawings, which illustrate a preferred embodiment of the invention, and in which.

DESCRIPTION OF THE PREFERRED EMBODIMENT

Figure 3:
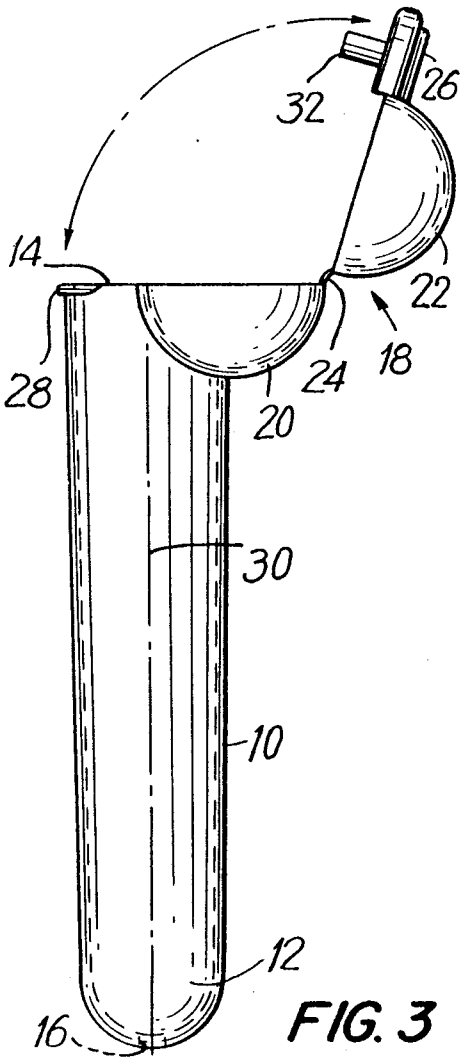

As illustrated in the drawings, the case of the invention comprises a first tubular member 10 having a closed end 12 and an open end 14. Conveniently, the closed end 12 is provided with a vent opening 16 to permit drying of the interior of the case and of a contained razor when the case is in a closed condition.

Formed integrally with the first tubular member 10 is a second tubular member indicated generally at 18, and which is comprised of a first portion 20 and a second portion 22, the respective portions 20 and 22 being connected one to the other by a living hinge 24 formed integrally with the first and second portions 20 and 22 during the molding thereof from polypropylene. Such a material provides for repeated flexure of the living hinge before fatigue failure of the living hinge occurs through such repeated flexures.

Figure 2:
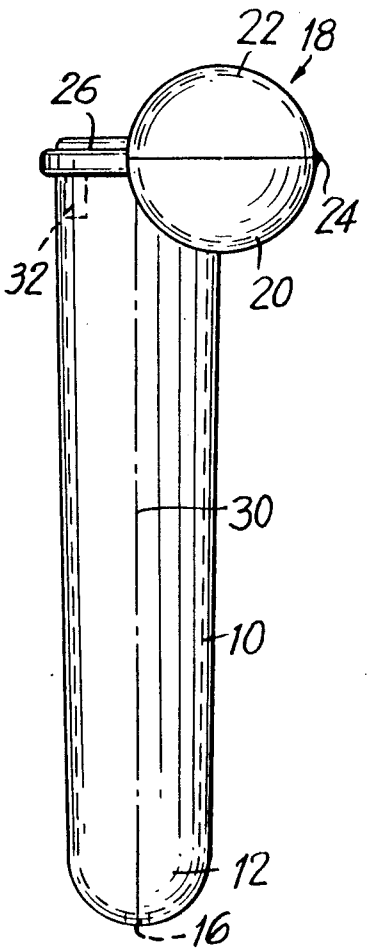
FIG. 2 is a side elevation of the case showing the case in a closed position; and, FIG. 3 is a view corresponding with FIG. 2, but showing the case when in an open condition.
Figure 1:
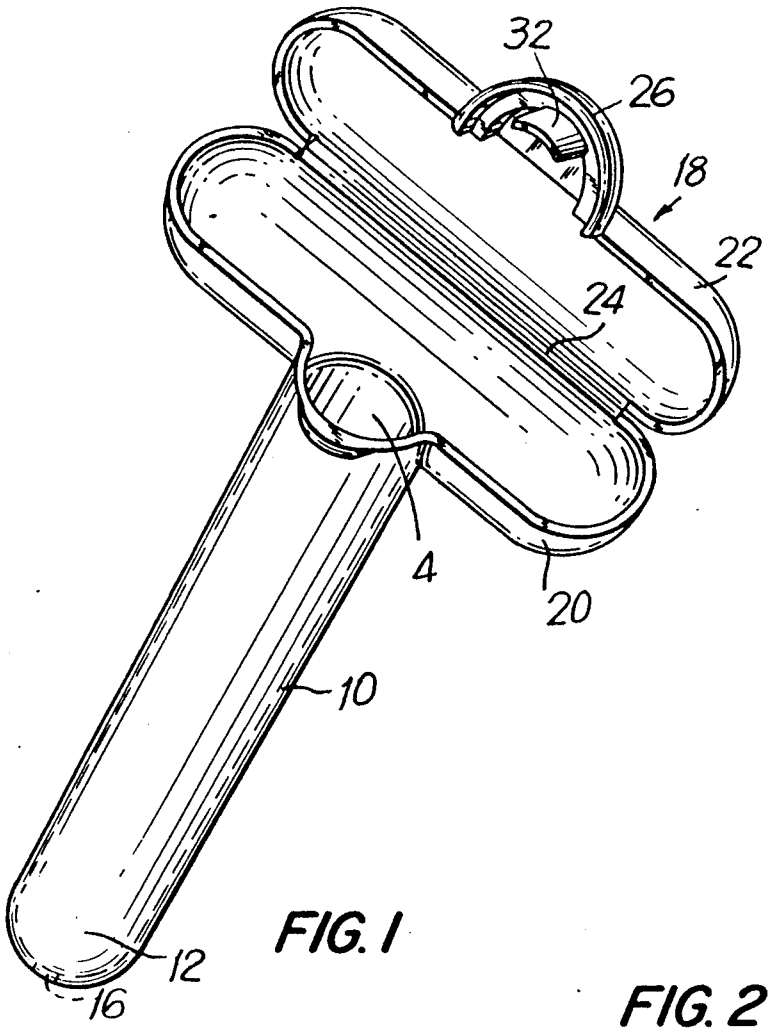
FIG. 1 is a perspective view of the razor case of the present invention when in an open condition.

The second portion 22 has formed integrally therewith a locking member of a configuration for it to provide one half of a cap for the open end of the tubular member 10, as more clearly illustrated in FIG. 2, the cap 26 being a snap fit over a projection 28 formed adjacent the open end of the tubular member 10, as illustrated in FIG. 3.

The portions 20 and 22 of the second tubular member 18 each are located on one side of a plane which includes the longitudinal axis 30 of the tubular member 10.

Conveniently, and in order to ensure registration of the second portion 22 on the first portion 20 and the open end 14 of the tube 10, an arcuate tab 32 is provided on the locking member 26, the tab 32 being so configured and positioned for it to be received within the bore of the first tubular member 10.

Conventional razors have an elongate axially straight handle portion that can be received within the bore of the first tubular member 10, the razor then having a neck portion which extends to one side of the handle, the neck portion and the cartridge blade razor carried thereby then being receivable within the first portion 20 of the second tubular member 18, subsequent to which the second portion 22 of the second tubular member 18 can be hinged downwardly from the position shown in FIG. 3 to the position shown in FIG. 2 to encase the razor and protect it from damage during transportation, for example, in the toilet articles compartment of personal luggage, or in an article of soft luggage.

As each of the respective portions of the case are formed integrally one with the other, the entire case is thus capable of being molded from thermoplastics material in a single one-shot molding operation, thus providing a case that requires no assembly, and which can be manufactured at extremely low cost by conventional injection molding techniques.

While the preferred embodiment of the case of the invention has been illustrated as being comprised almost exclusively by radiused surfaces it will be appreciated that the respective surfaces can be other than on a true radius of curvature, for example, they can be sections of an ellipse in curvature. While the case has been illustrated as being smooth and undecorated on its outer surface, it will be appreciated that conventional molding techniques will permit the external surfaces of the case to be decorated by ribbing, striations or the like, compatible with injection molding techniques. While the preferred embodiment of the invention has been illustrated as having external surfaces in the form of continuous curvatures, it will also be appreciated that selected portions of the exterior of the case could be formed as planar portions, such planar portions being interconnected one with the other through a transitional smooth radius of curvature, the object being to eliminate to the greatest possible extent any sharp edges that could cause damage to adjacent articles that have been stored together with the case of the invention in an article of luggage.

What is claimed is:

1. A molding of a moldable plastics material providing a housing of a single-edged personal razor, comprising:

a first cylindrical member of tubular cross-section having a longitudinal axis, and providing a closed end and an open end;

a second cylindrical member of tubular cross-section integral with said first cylindrical member at said open end of said first cylindrical member, said second cylindrical member having a longitudinal axis extending in a transverse plane perpendicular to the longitudinal axis of said first cylindrical member for said second cylindrical member to extend laterally outwardly of said first cylindrical member;

said second cylindrical member being comprised by a first portion of said second cylindrical member integral with said first cylindrical member and which has a substantially planar open side extending in a transverse plane perpendicular to the longitudinal axis of said first cylindrical member, and a second portion of said second cylindrical member hingedly connected to said first portion of said second cylindrical member by a living hinge extending along that portion of said first portion of said second cylindrical member that is positioned remote from the longitudinal axis of said first cylindrical member, said second tubular portion of said second cylindrical member terminating at its edge remote from said living hinge in a locking member cooperable with said first cylindrical member upon hinging of said second portion of said second cylindrical member relative to said first portion about said living hinge;

said first cylindrical member and said first and second portions of said second cylindrical member, including said living hinge and said locking member each being formed integrally one with the other as a unitary one-shot molding of a thermoplastic plastics material.

2. The holder of claim 1, further including a ventilation opening extending through said closed end of said first tubular member.

3. The housing of claim 1, in which said longitudinal axis of said first cylindrical member extends tangential to an outer periphery of said second cylindrical member.

4. The housing of claim 1, in which said first cylindrical member and said second cylindrical member each are circular in transverse cross-section, and each is of substantially the same diameter as the other.

* * * * *